US008083440B2

(12) United States Patent
Curtiss, III

(10) Patent No.: US 8,083,440 B2
(45) Date of Patent: Dec. 27, 2011

(54) RISER TENSIONER RESTRAINT DEVICE

(75) Inventor: Jason Post Curtiss, III, Houston, TX (US)

(73) Assignee: Diamond Offshore Drilling, Inc., Houston, TX (US)

( * ) Notice: Subject to any disclaimer, the term of this patent is extended or adjusted under 35 U.S.C. 154(b) by 260 days.

(21) Appl. No.: 12/537,855

(22) Filed: Aug. 7, 2009

(65) Prior Publication Data

US 2010/0047024 A1 Feb. 25, 2010

Related U.S. Application Data

(60) Provisional application No. 61/086,868, filed on Aug. 7, 2008.

(51) Int. Cl.
*E21B 17/01* (2006.01)

(52) U.S. Cl. ..... 405/224.4; 405/224.2

(58) Field of Classification Search ..... 405/195.1, 405/223.1, 224, 224.2, 224.4
See application file for complete search history.

(56) References Cited

U.S. PATENT DOCUMENTS

| | | | | |
|---|---|---|---|---|
| 4,379,657 | A | 4/1983 | Widiner et al. | |
| 4,449,854 | A * | 5/1984 | Nayler | 405/195.1 |
| 4,883,387 | A * | 11/1989 | Myers et al. | 405/224.4 |
| 5,160,219 | A * | 11/1992 | Arlt | 405/224.4 |
| 5,163,513 | A * | 11/1992 | Chancey | 166/345 |
| 5,169,265 | A * | 12/1992 | Butler et al. | 405/224.4 |
| 5,310,007 | A * | 5/1994 | Parikh | 166/355 |
| 5,524,710 | A * | 6/1996 | Shinn | 166/348 |
| 5,641,248 | A * | 6/1997 | Arlt, III | 405/223.1 |
| 5,758,990 | A * | 6/1998 | Davies et al. | 405/224.4 |
| 5,846,028 | A * | 12/1998 | Thory | 405/224 |
| 6,045,296 | A * | 4/2000 | Otten et al. | 405/224.4 |
| 7,438,505 | B2 * | 10/2008 | Olsen et al. | 405/224.4 |

* cited by examiner

*Primary Examiner* — Frederick L Lagman
(74) *Attorney, Agent, or Firm* — Osha Liang LLP

(57) ABSTRACT

An apparatus to restrain a riser tensioner of an offshore drilling rig includes a restraint cone configured to fit within hydraulic cylinders of the riser tensioner, a hoist configured to extend and retract the restraint cone, and a tension member extending from a lower end of the restraint cone, the tension member configured to engage a lower end of the riser tensioner and maintain a wedging action between the restraint cone and the hydraulic cylinders.

14 Claims, 2 Drawing Sheets

RISER TENSIONER RESTRAINT DEVICE

BACKGROUND

1. Field of the Disclosure

Embodiments disclosed herein relate generally to riser tensioners used on floating drilling vessels. Particularly, embodiments disclosed herein relate to apparatus and methods to secure a riser tensioner when not in use.

2. Background Art

Conventional offshore drilling for oil and natural gas from floating vessels typically requires a drilling riser, which is an assembly of jointed pipes that convey fluids from the drilling vessel down to a wellhead located on the seabed. Drilling risers must be kept in tension; otherwise, they may buckle under their own weight and the weight of the fluids they contain. Tension is typically maintained by a combination of floatation equipment attached to the drilling riser, and by a device on the drilling vessel called a riser tensioner.

Early drilling riser tensioners included wire ropes, one end of which was attached to the drilling riser, and the other end reeved over sheaves attached to large hydraulic cylinders that are attached to a drilling vessel. When the vessel heaved, the tension in the wire ropes, and thus in the drilling riser, was maintained by the hydraulic cylinders acting on the sheaves over which the wire ropes are reeved.

As offshore drilling has moved to deeper waters and lengths of drilling risers have increased, the required tension on the drilling riser has also increased, which has required larger diameter wire ropes. Large rope diameters, combined with repetitive stress cycles and the corrosive marine environment, may lead to much shorter service life for the wire ropes. Consequently, newer deepwater floating drilling rigs are equipped with direct-acting riser tensioners as disclosed in U.S. Pat. No. 4,379,657, issued to Widiner, in which a plurality of hydraulic cylinders are attached directly between the top of the drilling riser and the bottom of the floating drilling vessel.

Direct-acting riser tensioners may be advantageous over wire rope tensioners because the entire tensioner assembly may be moved away from the well-center and stowed. Certain operations, such as running or pulling the riser, or during transit of the vessel from one drilling location to another, may require stowing of the riser tensioner. Stowing the direct-acting riser tensioner typically involves moving it along a pair of tracks located in the moon pool area. One version of this track system for displacing a direct-acting riser tensioner system away from well-center is called the "N-Line Trip Saver" and is available from National Oilwell Varco, of Houston, Tex. In this system, the hydraulic cylinders of the riser tensioner are attached to a trolley that is propelled along a track by a hydraulically powered rack-and-pinion system.

However, when the direct-acting riser tensioner assembly is in the stowed position, it may be free to move about within the moonpool and can potentially cause damage to the vessel, to itself, or to associated equipment during periods of rough seas. Conventionally, the bottom of the riser tensioner assembly may be restrained by wire rope and shackles, but this approach is time-consuming, requires large diameter wire rope to handle the large loads involved, and requires a worker be suspended over open water in the moon pool to handle and attach the wires. If the seas are not calm, this operation may be hazardous.

Accordingly, there exists a need for apparatus and methods to restrain a direct-acting hydraulic riser tensioner assembly which will quickly and safely lock the riser tensioner in the stowed position.

SUMMARY OF THE DISCLOSURE

In one aspect, embodiments disclosed herein relate to an apparatus to restrain a riser tensioner of an offshore drilling rig, the apparatus including a restraint cone configured to fit within hydraulic cylinders of the riser tensioner, a hoist configured to extend and retract the restraint cone, and a tension member extending from a lower end of the restraint cone, the tension member configured to engage a lower end of the riser tensioner and maintain a wedging action between the restraint cone and the hydraulic cylinders.

In other aspects, embodiments disclosed herein relate to a method to restrain a riser tensioner, the method including moving the riser tensioner away from a well center, lowering a restraint cone to fit within hydraulic cylinders of the riser tensioner, extending a tension member from the restraint cone and engaging a lower ring of the riser tensioner, and wedging the restraint cone between the hydraulic cylinders, wherein the engagement between the restraint cone and the hydraulic cylinders restricts movement of the riser tensioner.

Other aspects and advantages of the invention will be apparent from the following description and the appended claims.

DETAILED DESCRIPTION

In one aspect, embodiments disclosed herein relate to apparatus and methods to secure a direct-acting riser tensioner when not connected to a riser.

Figure 1:
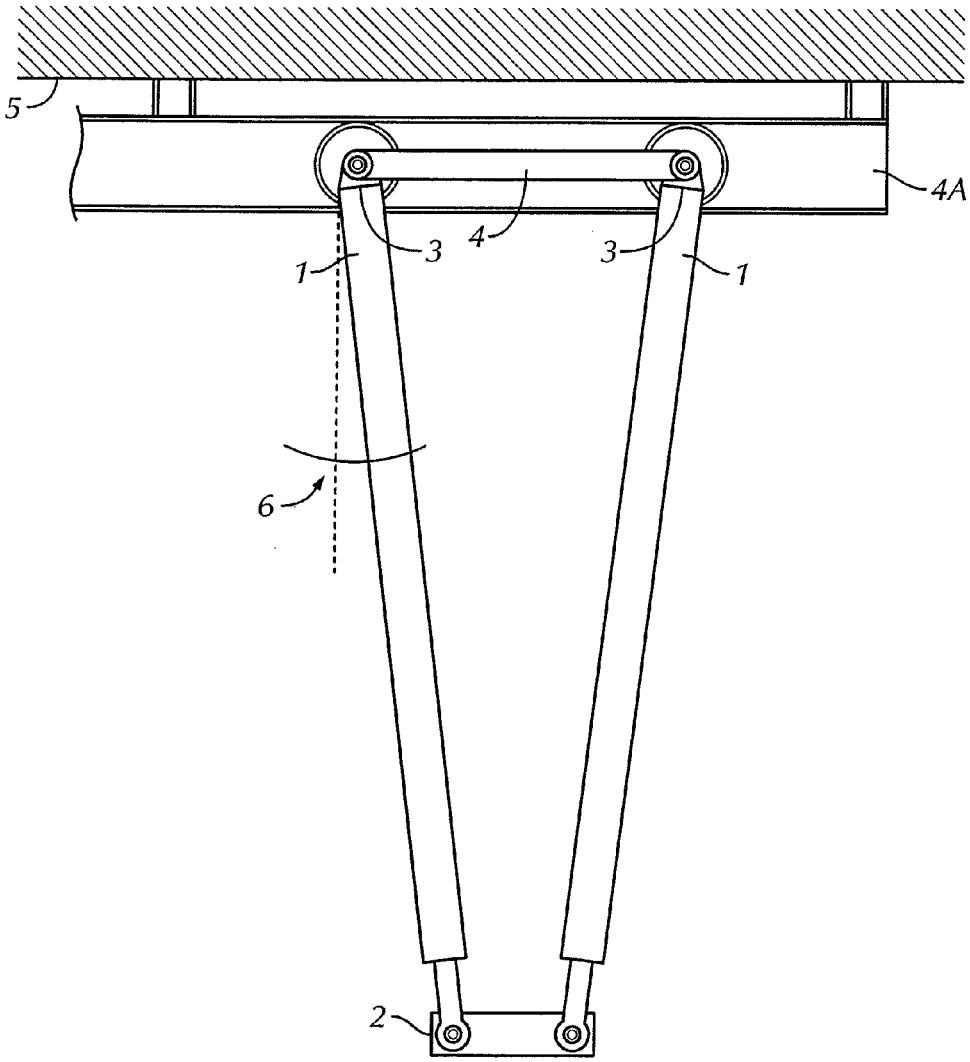
FIG. 1 PRIOR ART
FIG. 1 is an elevation view of a typical direct-acting riser tensioner.

Referring to FIG. 1, a typical direct-acting hydraulic riser tensioner system on a drilling vessel 5 is shown. Hydraulic cylinders 1 may be very large, with outer diameters above 20 inches and stroke lengths up to about 70 feet. Typically, riser tensioner systems have an even number of hydraulic cylinders 1 (commonly six hydraulic cylinders). Hydraulic cylinders 1 are attached on their lower ends to a riser ring 2, which is attachable to the upper end of the riser string (not shown). Riser ring 2 may, for example, be hinged and hydraulically latched to the top riser joint for easier attachment.

Hydraulic cylinders 1 may be attached at their upper ends 3 to a riser tensioner trolley 4 that runs on tracks 4A. Tracks 4A are attached to a structure of drilling vessel 5, typically to a drilling substructure that straddles the moon pool and supports the drill floor and derrick. Because the geometry of a drilling vessel dictates that the upper attachment points for a riser tensioner are farther apart than the diameter of the riser ring 2, the assembled hydraulic cylinders 1 attached to the drilling vessel 5 and the riser ring 2 generally form an inverted frusto-conical shape with cone angle 6.

Typically, hydraulic cylinders 1 are attached to the riser ring 2 and to the riser tensioner trolley 4 with shackles and padeyes, although other attachment methods may be possible and known in the art. In any event, the attachment method used must provide a substantial freedom of motion for the riser, due to the natural movement of the drilling vessel while drilling. For this reason, when the riser tensioner apparatus is stowed (as shown) with no vertical load on it, cylinders 1 and attached riser ring 2 may tend to oscillate violently within the moonpool due to wave action of the sea.

Figure 2A:
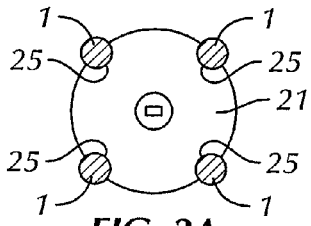
FIGS. 2A-2D are cross-section views of a restraint cone engaged with hydraulic cylinders in accordance with embodiments of the present disclosure.
Figure 2B:
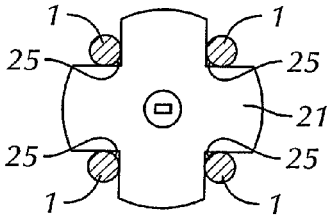
Figure 2C:
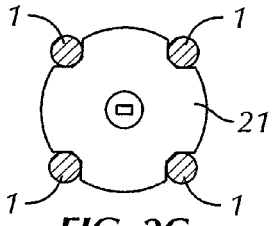
Figure 2D:
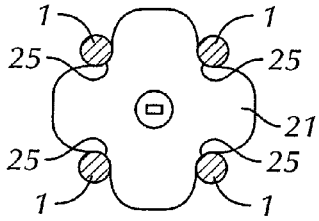
Figure 2:
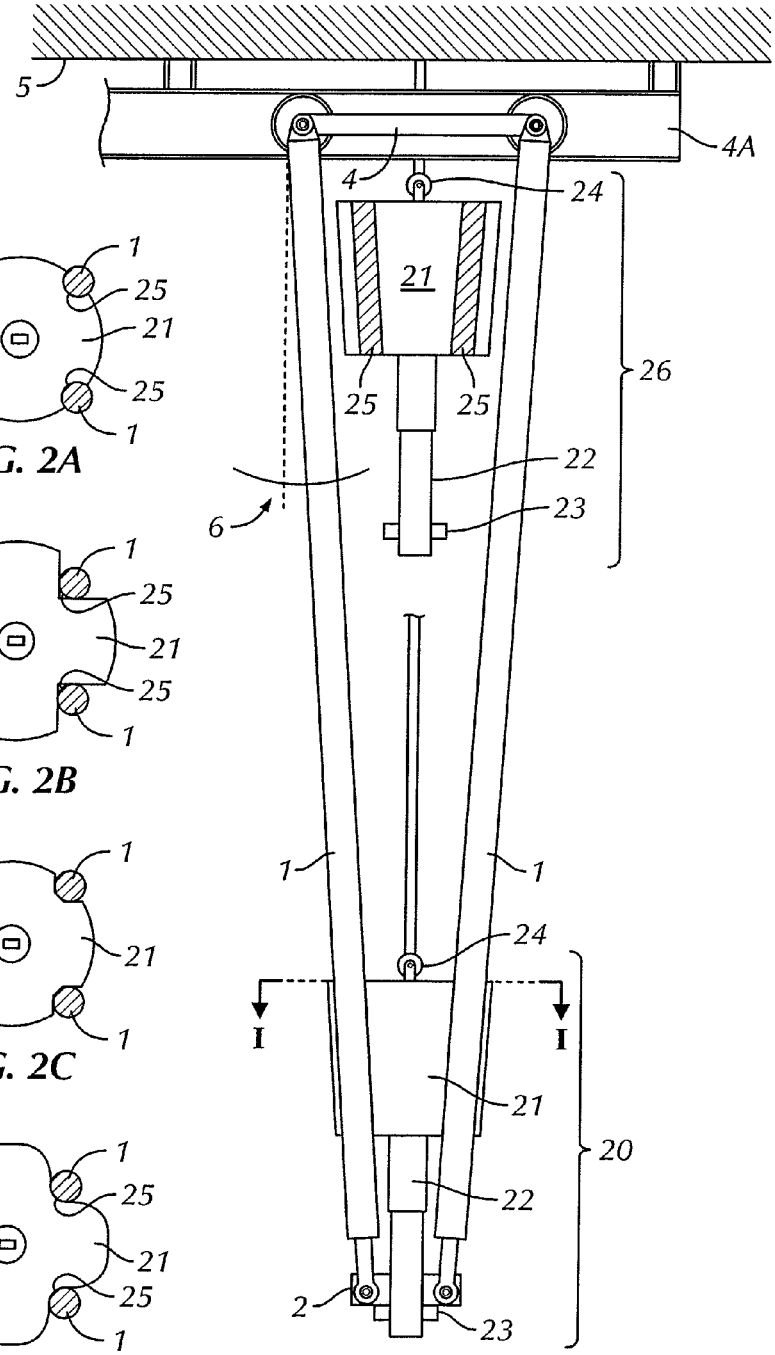
FIG. 2 is an elevation view of a riser tensioner locked in place with a restraint device in accordance with embodiments of the present disclosure.

Referring now to FIG. 2, a riser tensioner in a stowed position away from the well center, and locked in place by a riser tensioner restraint device, is shown in accordance with embodiments of the present disclosure. For illustrative purposes, the restraint device is shown in both an elevated, stowed position 26 and an extended, engaged position 20. As previously described, cylinders 1 are attached on their lower ends to the riser ring 2, and on their upper ends to riser tensioner trolley 4 running on tracks 4A.

The restraint device includes a restraint cone 21, a tension member 22, and a riser ring latching mechanism 23. Restraint cone 21 has a generally frusto-conical shape that matches the conical shape described by the hydraulic cylinders and, in particular, outer angle 6 (of FIG. 1). Restraint cone 21 may also include grooves 25 that are configured to engage cylinders 1 when restraint cone 21 is extended downward. In certain embodiments, restraint cone 21 may be fabricated from steel plate with molded polyurethane lining in the grooves 25. In other embodiments, restraint cone 21 may be molded from an elastomeric compound, including for example high-durometer rubber with a metal core, or other composites or polymers known to those skilled in the art.

The restraint system may also include a hoisting mechanism 24 used to raise and lower the riser tensioner restraint assembly into and out of engagement with the riser tensioner system. In certain embodiments, hoisting mechanism 24 may include at least one steel cable and a winch to raise and lower the riser tensioner restraint assembly between an elevated and extended position. The winch may be a pneumatic, hydraulic, or electric winch as know to those skilled in the art. Further, in certain embodiments, two steel cables may be attached to separate padeyes that are arranged on the top of the riser tensioner restraint assembly. The additional cable may help to prevent twisting, thereby maintaining a rotational alignment and properly orienting grooves 25 in the restraint cone 21 with the hydraulic cylinders 1 so that grooves 25 consistently engage the cylinders 1. Hoisting mechanism 24 may also be configured as a rack and pinion mechanism, a hydraulic cylinder, or other devices known to those skilled in the art.

Tension member 22 may include riser ring latches 23 that are configured to engage riser ring 2 when the restraint device assembly is in the extended position 20. The length of tension member 22 may be changed remotely by hydraulic or pneumatic pressure. In certain embodiments, tension member 22 may include concentric tubes with an internal, electrically-powered ball-screw or a pneumatically powered ball-screw, or other devices known to those skilled in the art.

After lowering the restraint device to the extended position 20, riser ring latching mechanism 23 secures the tension member 22 to the bottom of the riser ring 2. In certain embodiments, riser ring latching mechanism 23 may include spring-loaded radial pins near the distal end of the tension member 22 that latch to the riser ring. In other embodiments, the radial pins may be hydraulically or pneumatically actuated. In other embodiments, the riser ring latching mechanism 23 may include a riser ring 2 with hydraulic latches (for securing the riser ring 2 to the top riser joint (not shown)) and a mating groove near the distal end of the tension member 22. In still another embodiment, one double-ended hydraulic cylinder may serve the functions of both the hoisting mechanism 24 (described above) and the tension member 22.

Refer now to FIGS. 2A-2D, horizontal cross-sections of the assembly described in FIG. 2 are shown in the lower, engaged position 20 in accordance with embodiments of the present disclosure. It is noted that for clarity, in this example, there are four hydraulic cylinders 1 engaged by grooves 25 in the restraint cone 21, however, a person of ordinary skill in the art will understand that embodiments of the present disclosure are not limited to a riser tensioner with four hydraulic cylinders.

In the embodiment shown in FIG. 2A, grooves 25 in restraint cone 21 are shallow coves with a generally semi-circular cross-section. In the embodiment shown in FIG. 2B, grooves 25 are generally pie-shaped in cross-section, the major diameter of restraint cone 21 is larger, and it has a generally cruciform shape. In the embodiment shown in FIG. 2C, grooves 25 are generally trapezoidal in shape. The embodiment shown in FIG. 2D is similar to that shown in FIG. 2B, except that the grooves 25 include contours having a radius to engage the hydraulic cylinders 1. Embodiments of restraint cone 21 that are generally star-shaped (that is, with a larger major diameter and wide grooves, such as the cruciform embodiments shown in FIGS. 2B and 2D) may help guide hydraulic cylinders 1 into grooves 25 as the riser tensioner restraint assembly is lowered into place.

In a method of securely stowing a direct-acting hydraulic riser tensioner system, the riser tensioner trolley 4 is moved off of well center along tracks 4A as shown in FIG. 2. The riser tensioner restraint assembly is then lowered from the retracted position 26 (with the tension member 22 extended) to the extended position 20 until the grooves 25 engage the hydraulic cylinders 1. The riser ring latching mechanism 23 then engages the riser ring 2, and the tension member 22 pulls down and locks the restraint cone 21 into full engagement with the hydraulic cylinders 1. This effectively locks the riser tensioner restraint assembly in place such that the hydraulic cylinders 1 and the riser ring 2 are substantially immobilized.

Advantageously, embodiments of the present disclosure may be deployed remotely, without, for example, the need for a worker to be suspended over the moon pool. Also, embodiments of the present disclosure may be deployed and retracted very rapidly, thereby saving rig time and cost. Further, embodiments disclosed herein may have the capacity to resist very high lateral loads on the riser tensioner system caused by rough seas and heavy wave action. Finally, embodiments disclosed herein may easily be adapted to the various forms of power available on a drilling vessel (e.g., electrical, hydraulic, or pneumatic power).

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An apparatus to restrain a riser tensioner of an offshore drilling rig, the apparatus comprising:

a restraint cone configured to fit within hydraulic cylinders of the riser tensioner;

a hoist configured to extend and retract the restraint cone;

a tension member extending from a lower end of the restraint cone, the tension member configured to engage a lower end of the riser tensioner and maintain a wedging action between the restraint cone and the hydraulic cylinders.

2. The restraint device of claim 1, in which the restraint cone further comprises grooves in the outer surface which mate to the hydraulic cylinders of the riser tensioner.

3. The restraint device of claim 2, wherein the grooves comprise a generally semicircular cross-section.

4. The restraint device of claim 2, wherein the grooves comprise a generally trapezoidal cross-section.

5. The restraint device of claim 2, wherein the grooves comprise a generally triangular cross-section.

6. The restraint device of claim 2, wherein the grooves comprise a radiused contour cross-section.

7. The restraint device of claim 1, further comprising a wire rope and a winch to extend and retrieve the restraint cone.

8. The restraint device of claim 7, further comprising a plurality of wire ropes to maintain rotational alignment of the restraint cone with the hydraulic cylinders of the riser tensioner.

9. The restraint device of claim 1, further comprising a plurality of ring latches configured to engage a riser ring of the lower end of the riser tensioner.

10. A method to restrain a riser tensioner, the method comprising:

moving the riser tensioner away from a well center;

lowering a restraint cone to fit within hydraulic cylinders of the riser tensioner;

extending a tension member from the restraint cone and engaging a lower ring of the riser tensioner; and wedging the restraint cone between the hydraulic cylinders;

wherein the engagement between the restraint cone and the hydraulic cylinders restricts movement of the riser tensioner.

11. The method of claim 10, further comprising disengaging the tension member and the lower ring, and retracting the restraint cone.

12. The method of claim 10, further comprising moving the riser tensioner away from the well center with a trolley.

13. The method of claim 10, further comprising aligning grooves within the restraint cone with the hydraulic cylinders of the riser tensioner.

14. The method of claim 10, further comprising extending and retracting the restraint cone with a wire rope and a winch.

* * * * *